United States Patent [19]

Trine et al.

[11] Patent Number: 4,803,599

[45] Date of Patent: Feb. 7, 1989

[54] MOUNTING BAR STRUCTURE FOR ELECTRICAL SIGNALLING AND INDICATING DEVICES

[75] Inventors: John A. Trine, Lake Elmo; Daryle L. Petersen, Eagan, both of Minn.

[73] Assignee: Wilbrecht Electronics, Inc., St. Paul, Minn.

[21] Appl. No.: 118,199

[22] Filed: Nov. 6, 1987

[51] Int. Cl.[4] ..... F21V 21/00

[52] U.S. Cl. ..... 362/249; 362/250; 362/800

[58] Field of Search ..... 362/285, 249, 800, 287, 362/250; 439/56

[56] References Cited

U.S. PATENT DOCUMENTS

| | | | |
|---|---|---|---|
| 455,749 | 11/1885 | Rifkin et al. | 362/249 |
| 4,195,330 | 3/1980 | Savage, Jr. | 362/800 X |
| 4,206,493 | 6/1980 | Towne et al. | 362/800 X |
| 4,376,966 | 3/1983 | Tieszen | 362/249 |
| 4,398,240 | 8/1983 | Savage, Jr. | 362/800 X |
| 4,471,415 | 9/1984 | Larson et al. | 362/249 X |
| 4,575,785 | 3/1986 | Lerude et al. | 362/800 X |
| 4,727,648 | 3/1988 | Savage, Jr. | 362/226 X |

*Primary Examiner*—Ira S. Lazarus
*Assistant Examiner*—Peggy Neils
*Attorney, Agent, or Firm*—Moore & Hansen

[57] ABSTRACT

A mounting bar assembly for versatile positioning and orientation of indicator lights such as light emitting diodes (LED's). The mounting bars are cut to a desired length to accommodate a desired number of LED's and are cut to provide a plurality of slots at predetermined, spaced LED locations. The connector leads of the LED's are inserted within the slots and adjusted in a direction generally perpendicular to the longitudinal direction of extent of the mounting bar so as to position each LED at a desired height with respect to a printed circuit board or other electrical circuit device to which the leads are connected. The connector leads are malleable, and after being secured to the mounting bar, are bent to any desired configuration so as to support each LED in a particular orientation as required.

13 Claims, 1 Drawing Sheet

MOUNTING BAR STRUCTURE FOR ELECTRICAL SIGNALLING AND INDICATING DEVICES

BACKGROUND OF THE INVENTION

This invention relates to a mounting structure for supporting an assembly of indicator lights, particularly of the light-emitting diode (LED) type.

Manufacturers of electronic equipment of various types, including computers, copying machines, television sets and microwave ovens, as well as an infinite variety of electrical instruments, have used indicator lights or LED devices to serve as function indicators. The requirements of the particular electrical apparatus or appliance with which the LED indicators are used often dictate that the LED indicators should be spaced and oriented in a particular arrangement. Holders and mounting devices of various kinds have been devised and used for supporting a plurality of indicator lights, such as LED's in a desired array. Most of such LED holders do not provide any means for selectively spacing the LED's along the length of the holder with respect to each other, much less any way for selectively locating each LED at a desired vertical disposition or height location with respect to the elongated holder.

U.S. Pat. No. 4,471,415 discloses a mounting bar for indicator lights which does provide a means for supporting a plurality of LED indicators at predetermined locations with respect to each other along the length of the mounting bar. That patent is owned by a common assignee herewith. The mounting bar disclosed in the aforesaid patent does not provide any means for selectively positioning each LED at a desired vertical location or height with respect to the elongated mounting bar.

There is a definite need for some means for mounting LED indicators at predetermined heights with respect to electrical circuit connectors, particularly including printed circuit boards. For applications where the LED indicator must be displaced above a printed circuit board at an exact height, spacers have been used, either as separate spacer elements or formed integrally with the LED units. Such spacers must be manufactured to predetermined lengths, and specified by the manufacturer when ordering in order to achieve the particular height location desired for each LED on a printed circuit board. The spacers necessarily increase the cost of the LED assembly.

Having in mind the need for some means of mounting a plurality of LED indicators at predetermined lateral spacings with respect to each other, as well as at predetermined height locations with respect to the mounting device, for installation and connection to an electrical circuit in a quick and easy manner, we have developed a mounting bar which permits a plurality of LED indicators to be secured thereon at a predetermined, lateral spacing, as well as at a predetermined height with respect to the mounting bar according to particular user requirements. Adjustability of each LED to a particular angular orientation is also achieved so as to be able to meet special requirements of certain electrical apparatus calling for selective orientation of each LED in an array.

BRIEF SUMMARY OF THE INVENTION

This invention has as its primary objective the provision of an indicator light assembly comprised of a plurality of indicator lights, e.g. LED units, supported not only at predetermined, spaced locations with respect to each other along the length of a mounting device, but also secured at predetermined height locations.

A further objective is to provide such an assembly of indicator lights wherein each separate indicator light may be angularly oriented as desired so as to extend in a particularly desired direction for certain electrical applications.

The foregoing objectives are coupled with the need to provide indicator lights at such predetermined space locations with respect to each other on a mounting device which permits the efficient and economical assembly of the indicator lights, as well as the ultimate connection of each indicator light to the electrical contacts of a connecting circuit, such as that of a printed circuit board.

The aforesaid objects have been effectively met by the use of an elongated mounting bar having slots formed therein at predetermined, spaced locations along the length of the mounting bar, the slots defining in combination with the mounting bar a connector lead containment area within which the pairs of connector leads of each LED may be readily inserted and adjusted in a direction generally perpendicular to the longitudinal direction of extent of the mounting bar so as to position each LED indicator light at a predetermined height with respect to the mounting bar. The connector leads are secured in place within the slots and affixed to the mounting bar, as by glue, such as an epoxy resin, with a predetermined lead length projecting from the mounting bar on the side thereof opposite the indicator light for connection to an electrical contact means, such as a printed circuit board.

As a particularly advantageous feature of the indicator light mounting assembly, each of the connector leads is made of a conductive metal which is malleable and bendable, yet rigid enough to be self-supporting and to hold any position to which it is bent. Thus, after the conductor leads of each indicator light are affixed to the mounting bar, the portions of the leads projecting outwardly from the mounting bar between the bar and the indicator lights may be bent to any desired angle or configuration so as to orient each indicator light in a predetermined, desired position for a particular end use.

In a preferred embodiment of the invention, the aforesaid mounting bar preferably is in the form of a C-shaped, elongated member, preferably molded from plastic, so as to define top and bottom walls projecting from a back wall, with the top and bottom walls vertically spaced apart so as to define an open channel therebetween. The aforesaid slots are formed in the top and bottom walls of the bar, with the connector leads extending through vertically aligned pairs of slots, as well as through the open channel of the bar. The leads are advantageously secured in place to the bar by filling the channel with glue so that the glue flows around the leads and hardens to the leads as well as to the inside surface of the mounting bar channel.

The indicator light assembly described above is basically of the type in which the freely projecting ends of the connector leads are extended through a printed circuit board for soldering thereto. However, as a particular benefit of the LED mounting structure set forth above, the malleable and bendable leads may be bent to a generally horizontal configuration in a common plane so as to permit the leads to be positioned to lie along the surface of a printed circuit board for surface mount attachment thereto.

As a further advantageous feature, a removable support member is provided for sliding attachment to at least one end of the open-ended channel bar, with the support member having depending feet which project below the bar to rest on a circuit attachment surface, such as that of a printed circuit board. In this manner, the mounting bar with a plurality of indicator lights secured thereto may be held in a stable position by one or more of such support members while the connector leads are soldered to a printed circuit board or other electrical circuit device.

DESCRIPTION OF THE PREFERRED EMBODIMENTS

Figure 1:
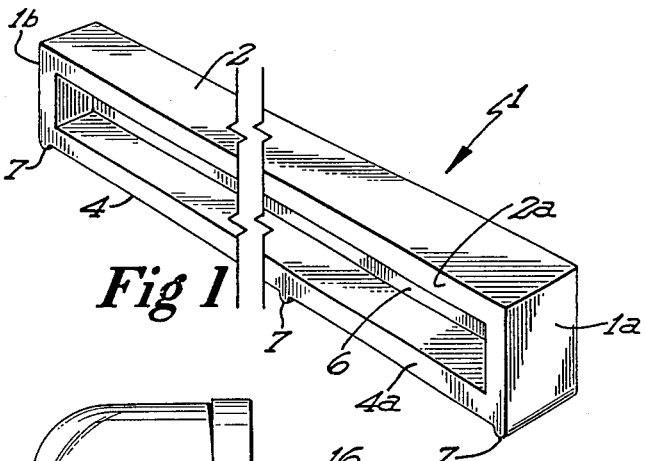
FIG. 1 is a perspective view of the mounting bar device of this invention as originally formed.

As shown in FIG. 1, the mounting bar utilized to provide the versatile, infinitely variable mounting locations of indicator lights, is initially formed as an elongated channel member having planar top and bottom walls 2 and 4 extending longitudinally thereof and terminating at closed end walls 1*a* and 1*b*. Top and bottom walls 2 and 4 are connected by an upright back wall 6 from which they extend in vertically spaced-apart relation so as to define an open channel therebetween. Top wall 2 has a free front edge 2*a*, and bottom wall 4 has a free front edge 4*a*. Transversely extending ribs 7 are provided at spaced apart locations along bottom wall 4 in order to support the mounting bar at a slightly elevated position above the surface with which it is used.

Although mounting bar 1 may be formed in various ways from different materials, it is preferably molded as a unitary structure from a high temperature, thermoplastic resin such as a polyester or polyphenolene sulfide.

Figure 2:
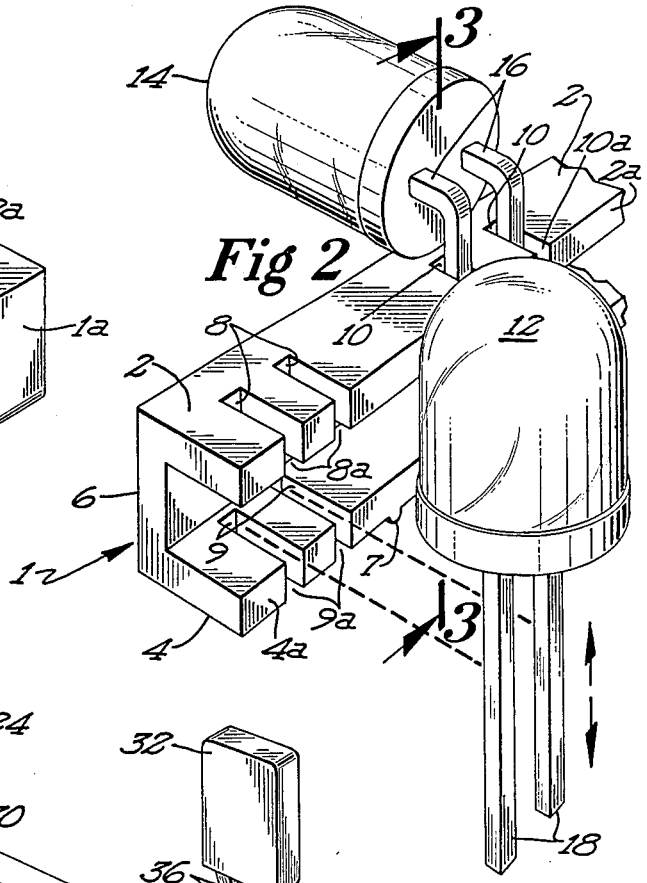
FIG. 2 is a perspective view of the mounting bar after being cut to the desired length and having the connector lead receiving slots cut therein.
Figure 4:
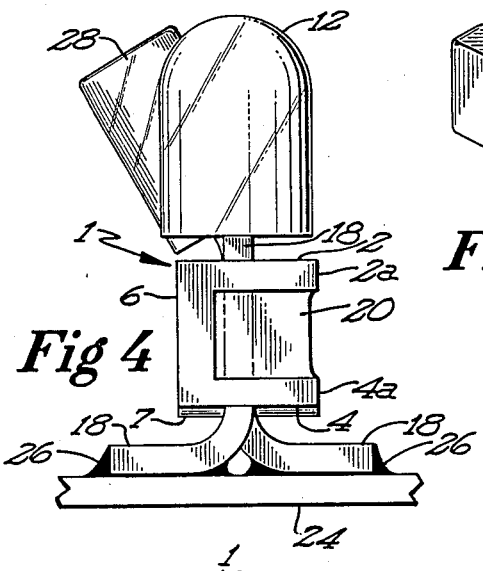
FIG. 4 is an end elevation view of the mounting bar and indicator light assembly of this invention with the connector leads of an LED bent to a horizontal configuration for surface mounting on a printed circuit board.
Figure 6:
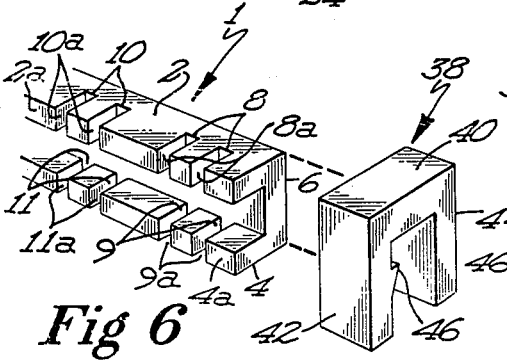
FIG. 6 is a perspective view of the cut and formed mounting bar of this invention with a stabilizing support member shown in exploded position with respect to its attachment location on one end of the bar.

After initially being molded in the form shown in FIG. 1, the mounting bar 1 is cut to a desired length to meet particular specifications, thus leaving the ends of the generally C-shaped mounting bar open as is shown in FIGS. 2 and 4. A gang saw or other appropriate cutting tool is then utilized to cut a plurality of slots through top and bottom walls 2 and 4 at predetermined spaced-apart locations along the length of the mounting bar 1. Such slots are cut in laterally spaced pairs in order to accommodate the pair of connector leads attached to each LED or other form of indicating light. Thus, as is most clearly shown in FIGS. 2 and 6, a first pair of slots 8 is cut through top wall 2, with vertically aligned slots 9 being cut through bottom wall 4. A second pair of top and bottom slots 10 and 11 is formed a predetermined distance away from slots 8 and 9 along the length of planar, top and bottom walls 2 and 4. It is to be understood that any number of slots may be utilized, at predetermined lateral spacings from each other along the mounting bar to accommodate the LED mounting requirements for particular applications. It is to be noted that each of the slots 8, 9, 10, and 11 extend through the tree edges 2*a* and 4*a* of the top and bottom walls 2 and 4 so as to provide exposed slot access openings through which the leads of indicator lights may be inserted for proper placement and positioning.

In FIG. 2 there is shown two indicator lights in the form of LED units 12 and 14 of cylindrical, domed shape configuration as are commonly employed on various types of electrical equipment. LED's 12 and 14 have connector leads 16 and 18 connected thereto for electrical connection with an electrical contact on a circuit device, such as a printed circuit board. Leads 16 and 18 are initially inserted through the exposed access openings 8*a*, 9*a*, 10*a*, and 12*a* of the slots 8, 9, and 10, 11, with the leads passing through aligned, vertically spaced pairs of slots 8, 9, and 10, 11 as is indicated with respect to leads 16 in FIG. 3. Also, each lead will pass through the channel defined between top and bottom walls 2 and 4, as shown. At this point in the assembly process, the connector leads 16, 18 are adjusted vertically upwardly and downwardly within the slots in a direction generally perpendicular to the longitudinal direction of extent of top and bottom walls 2 and 4 so as to locate each of the indicator lights or LED's 12 and 14 at a desired height a predetermined displacement distance from top wall 2 of the mounting bar 1. The mounting bar 1 will normally be held in a fixture while the connector leads are placed and positioned within the slots 8, 9 and 10, 11.

After being thus vertically positioned along their vertical direction of extent, leads 16 and 18 are secured to mounting bar 1. This may be accomplished in various ways. As a preferred method and procedure, a glue is introduced into the channel formed between top and bottom walls 2 and 4, along back wall 6, with the glue flowing around the connector leads. When the glue hardens to the inside surfaces of the channel walls 2, 4, and 6, as well as to the leads, it will have secured the leads firmly in place on the bar 1. The glue 20 is shown within the channel in its hardened state in FIGS. 3, 4, and 5. The glue will preferably be a thermoset, epoxy resin of the type commercially available.

Heat staking may also be used to secure the connector leads within the mounting bar slots, preferably as an intermediate step for supporting leads in their desired positions of vertical adjustment within the slots prior to applying glue within the mounting bar channel. In such a heat staking operation, a tool with a heated tip is applied to the thermoplastic resin material of mounting bar 1 around slots 8, 9 and 10, 11. This causes melting of the plastic material of the bar, which is rolled over into the slots around the leads.

Figure 8:
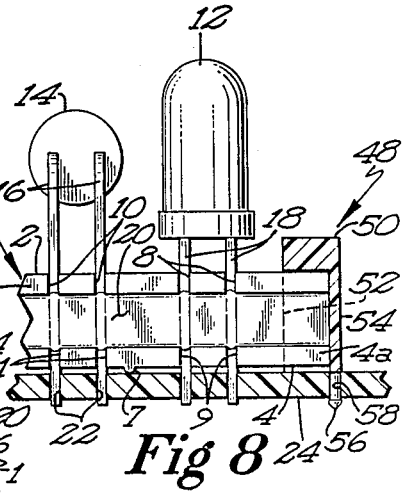
FIG. 8 is a side elevation view, partially in section, showing a modified version of a stabilizing support member utilized in conjunction with the mounting bar and indicator light assembly of this invention.

After the LED leads are set in place in the elongated channel, within the slots of mounting bar 1, they are either left in the straight, upright position as shown with respect to leads 18 in FIG. 2 and in FIG. 8, or they are bent to the desired configuration for the specified indicator light orientation of the particular electrical equipment manufacturer for whom the particular indicator light assembly is being made. For this purpose, the connector leads are made out of a conductive metal, such as tin-plated copper or nickel, which is sufficiently bendable and malleable to be able to be bent and formed to various shapes, yet rigid enough to be self-supporting so as to hold any position to which the leads are bent. Thus, as is illustrated with respect to LED 14 in FIGS. 2 and 3, leads 16 may be bent to a right angle configuration between the top wall 2 of mounting bar 1 and the base of LED 14 so as to orient the elongated LED 14 in a generally horizontal position as shown for particular applications. Alternatively, the connector leads may be inclined at an angle from mounting bar top wall 2 so as to dispose the LED at an angle, as is illustrated with respect to generally cylindrical-shaped LED 28 in FIG. 4.

Figure 5:
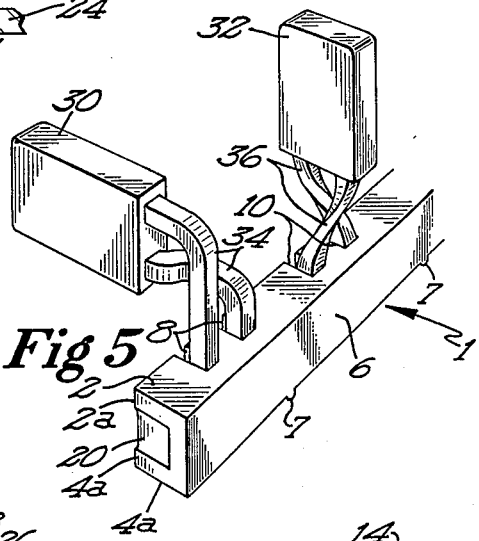
FIG. 5 is a perspective view showing separate LED units affixed to the mounting bar of this invention with the leads bent so as to position the indicator lights at particular desired positions and orientations.

In FIG. 5 there is illustrated a further variation of the forming of the indicator light leads so as to position LED's of flat, rectangular configuration as shown at 30 and 32 in particular, desired locations and orientations. Thus, the leads 34 of LED 30 are bent and formed as shown in FIG. 5 so as to position flat LED 30 in a generally vertical plane extending substantially at right angles to the longitudinal direction of mounting bar 1. Elongated, generally rectangular LED 30 is oriented in a generally horizontally extending position, whereas the leads 36 of LED 32 are twisted as shown so that LED 32 is oriented generally vertically, but also in a plane perpendicular to the longitudinal direction of extent of mounting bar 1. In this way, the LED's can be located at a particular height and oriented as desired for proper viewing in the particular electrical apparatus in which they are mounted.

Figure 3:
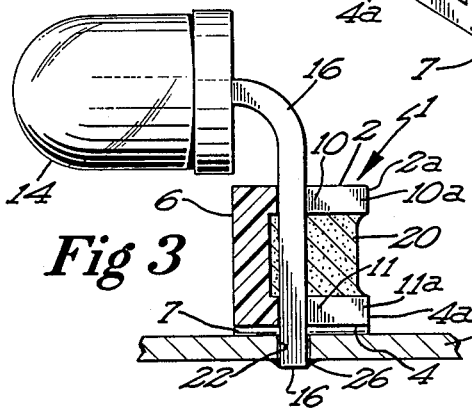
FIG. 3 is a vertical section view taken along lines 3—3 of FIG. 2 and showing the mounting bar with a light-indicating device and its leads secured thereto.

The connector leads of each of the LED's will initially be longer than required, and will be trimmed to the desired length after being secured within the mounting bar 1. For conventional connection to a printed circuit board, in a vertical mount type of application, the bottom of the connector leads extending below the bottom wall 4 of mounting bar 1 will be trimmed only short enough to be inserted through the apertures normally provided in a printed circuit board for soldering of the leads in place. Such an application is illustrated in FIG. 3 wherein the leads 16 of LED 14 are shown inserted within aperture 22 of printed circuit board 24 for electrical connection therewith. The soldered joint of the leads to the printed circuit board 24 is indicated at 26.

In certain printed circuit board applications, it is necessary for the leads of LED's or other forms of indicators to be secured flush to the top surface of a printed circuit board in a so-called surface mount arrangement. In the past there has been no way to adapt conventional LED mounting bar assemblies with the LED's supported in a generally upright or vertical mount position to permit such a surface mounting of the LED leads. The mounting bar assembly disclosed herein overcomes that problem. As is illustrated with respect to leads 18 of LED 12 in FIG. 4, the leads are trimmed to extend for a greater length beyond the underside of mounting bar bottom wall 4 than in the mounting arrangement of FIG. 3. After being secured in place on mounting bar 1 by glue 20, the depending, free ends of leads 18 are bent to a generally horizontal configuration to lie in a common horizontal plane as shown. This permits them to be positioned flat against the top surface of printed circuit board 24 for surface mount soldering thereto.

Figure 7:
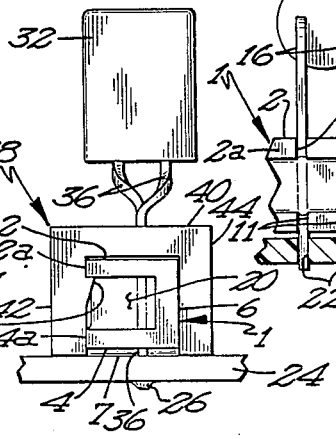
FIG. 7 is an end elevation view showing the stabilizing support member of FIG. 6 attached to the mounting bar and being utilized in conjunction with a printed circuit board.

In the process of soldering the connector leads of light-indicating devices mounted on bar 1 to a printed circuit board, there is sometimes a tendency for the mounting bar to tip over or otherwise dislodge during the soldering process. This would be especially true, for example, with the embodiment of FIG. 3 if a plurality of LED devices 14 are oriented in a right angle configuration with the indicator lights extending horizontally to one side of the mounting bar. The weight of the indicator lights so positioned at an offset location with respect to the bar would tend to tip the bar over. Accordingly, in order to stabilize the mounting bar during attachment operations for the leads, a stabilizing support member as generally indicated by reference numeral 38 in FIGS. 6 and 7 may be utilized. Support member 38 is preferably of inverted, U-shape and comprises a pair of legs 42 and 44 connected at their upper ends by a cross-member 40. The support member 38 is slidably attached to one end of mounting bar 1. In its position of attachment, support member 38 is slidably supported over one end of the mounting bar so that cross-member 40 overlies top wall 2 of the mounting bar with legs 42 and 44 depending downwardly on opposite sides of the mounting bar as shown in FIG. 7. Support member legs 42 and 44 are of such a length that they will depend downwardly below bottom wall 4 of the mounting bar so as to engage the top surface of a printed circuit board 24. In order to removably secure support member 38 to one end of the mounting bar 1, a shoulder 46 is provided on the inside surface of one of the mounting bar legs 42. Shoulder 46 frictionally engages under the inside, lower surface of top wall 2 of the mounting bar in a friction fit therewith, at one end of the mounting bar. For this purpose, the end of the mounting bar to which support member is attached must be open, and not filled with glue. This may be accomplished by using separator plates or baffles during the application of the glue to leave a clearance space either at one end of the mounting bar channel, or along the whole length of the mounting bar channel towards the front end of the top and bottom walls 2 and 4. Alternatively, support member 38 may be mounted on one end of the bar 1 when the glue is still in a fluid state so as to be able to force shoulder 46 inside of the mounting bar channel. It is also contemplated that a shoulder such as that shown at 46 could be formed on the lower, inside surface of one of the support member legs 42 so as to engage under bottom wall 4 of the mounting bar in frictional contact therewith.

It will be appreciated that with one or more support members 38 affixed to mounting bar 1 at opposite ends thereof, the bar will be securely supported during the soldering attachment of the connector leads to the printed circuit board.

In FIG. 8 there is illustrated an alternative form of a stabilizing support member for the mounting bar, with the support member being generally indicated by reference numeral 48. This form of the support member 48 has a top wall or cross-member 50 which extends across the top of bar top wall 2. It also has depending side legs which embrace the opposite sides of the mounting bar, one of which is indicated at 52. An end wall 54 is formed on support member 48 to fit snuggly against the end of mounting bar 1 as shown. One or more pins 56 depend downwardly from end wall 54 and are inserted into apertures 58 provided in the printed circuit board 24 for that purpose. In this way, the mounting bar assembly is even more securely attached to a printed circuit board to stabilize it while the exposed bottom ends of the connector leads 16 and 18 are being soldered to the contacts of the printed circuit board.

Those skilled in the art will appreciate that the mounting bar assembly disclosed herein may be utilized for the versatile mounting of different types of indicator components, in addition to LED's . Any type of signal or indicator device having connector leads can be utilized with the mounting bar disclosed herein. As described and shown herein, the conventional LED's would normally have two connector leads attached thereto. However, in the case of bicolor LED's , three connector leads are used, and are color-coded for connection to two different colored indicator lights within a single LED housing. For LED's having three leads, the mounting bar 1 would of course be formed and cut with slots so that the slots are in sets of three laterally spaced adjacent to each other to receive each set of three leads on an LED.

It is anticipated that various other changes may be made in the size, shape, construction, and manner of assembly of the mounting bar and indicator light arrangement disclosed herein without departing from the spirit and scope of the invention as defined in the following claims.

What is claimed is:

1. An indicator light assembly comprising:

an elongated mounting bar having planar wall means extending longitudinally thereof;

a plurality of apertures extending through said wall means at predetermined locations along the length of said bar;

a plurality of indicator lights supported on said mounting bar at predetermined, spaced-apart locations thereon as defined by said apertures, each of said indicator lights having a plurality of electrical connector leads attached thereto and extending therefrom in the same direction whereby each indicator light is freely suspended along one end of a pair of said leads, and said apertures being arranged in laterally adjacent sets, with the rest of leads for each indicator light being contained within a set of said apertures to extend in a direction generally perpendicular to the longitudinal direction of extent of said wall means at a desired position of adjustment along said lead direction, with each of said indicator light being freely supported at a desired height a predetermined displacement distance from said planar wall means only along said one end of a pair of said leads;

means securing each of said connector leads within said apertures and affixing said leads to said mounting bar only along the opposite ends thereof from said one end, with a predetermined lead portion opposite said one end thereof being exposed for connection to an electrical contact means; and each of said connector leads being made of conductive metal which is malleable and bendable, yet rigid enough to be self-supporting and to hold any position to which it is bent, whereby the lengths of said leads projecting outwardly from said mounting bar between said mounting bar and said indicator lights may be bent to any desired angle or configuration so as to orient each of said indicator lights in a predetermined, desired position.

2. An indicator light assembly as defined in claim 1 wherein:

said wall means has a free edge along the planar direction of extent thereof, and said apertures are in the form of slots extending to and through said free edge to provide exposed slot access openings along said free edge, whereby said connector leads may be inserted into said slots through said access openings in a direction coextensive with said planar direction of extent of said planar wall means.

3. An indicator light assembly as defined in claim 1 wherein:

each of said indicator lights is an LED.

4. An indicator light assembly as defined in claim 1 wherein:

said means affixing said connector leads to said mounting bar comprises glue.

5. An indicator light assembly as defined in claim 4 wherein:

said glue is an epoxy resin.

6. An indicator light assembly as defined in claim 1 wherein:

said mounting bar is of generally C-shaped configuration when oriented horizontally with said connector leads extending generally vertically through said apertures and said planar wall means comprises top and bottom walls projecting from a back wall of said mounting bar, and said top and bottom walls being vertically spaced apart in said horizontal orientation of said bar to define an open channel therebetween, and said apertures comprising vertically aligned pairs of openings extending through said top and bottom walls, with each lead passing through an aligned, vertically-spaced pair off said openings as well as through said channel and being contained therein.

7. An indicator light assembly as defined in claim 6 wherein said means affixing said leads to said mounting bar comprises glue applied within said channel around said leads.

8. An indicator light assembly as defined in claim 1 wherein the connector leads of at least one indicator light affixed to said mounting bar depend beyond said mounting bar on the side thereof opposite said indicator light and are bent to a generally horizontal configuration in a common plane, whereby said leads may be positioned to lie along the surface of a printed circuit board for surface mount attachment thereto.

9. An indicator light assembly as defined in claim 8 wherein:

said mounting bar is of generally C-shaped configuration and said planar wall means comprises top and bottom walls projecting from a back wall of said mounting bar in parallel spaced-apart relation to define an open channel therebetween, said channel being open at least at one end of said mounting bar; and at least one support member removably positioned on and embracing said one end of said mounting bar to stabilize said mounting bar during connection of said connector leads to electrical contact means such as a printed circuit board, said support member having a portion thereof restrainably

10. An indicator light assembly as defined in claim 9 wherein:

said support member is of inverted U-shaped and comprises a pair of legs connected at their upper ends by a cross member, said support member being slidably attached to said one end of said mounting bar with said cross member overlying only an end segment of said top wall adjacent said one end of said mounting bar and said legs depending downwardly below said bottom wall of said mounting bar on opposite sides thereof in position to rest on the surface of the electrical device to which the leads of said indicator lights are to be connected.

11. An indicator light assembly as defined in claim 10 wherein:

said portion of said support member restrainably engaging said mounting bar comprises a shoulder projecting from the inside surface of one of said legs and engaging under the inside, lower surface of said top wall.

12. An indicator light assembly as defined in claim 7 wherein:

said leads are substantially the same width as said openings, with enough clearance being provided in the width of said openings for the insertion of said leads therein.

13. An indicator light assembly as defined in claim 6 wherein:

said C-shaped mounting bar is open along the side thereof opposite said back wall, and each of said top and bottom walls have a free edge along said open side of said C-shaped mounting bar; and said apertures comprise slots extending through said top and bottom walls and to said free edge thereof to provide exposed acesses openings along said free edges of said top and bottom walls, whereby said connector leads may be inserted into said slots through said access openings to extend in said direction generally perpendicular to said top and bottom walls.

* * * * *

UNITED STATES PATENT AND TRADEMARK OFFICE

CERTIFICATE OF CORRECTION

PATENT NO. : 4,803,599

DATED : February 7, 1989

INVENTOR(S) : John A. Trine and Daryle L. Petersen

It is certified that error appears in the above–identified patent and that said Letters Patent is hereby corrected as shown below:

In column 3, line 50, change "channel member having" to --channel member 1 having--.

In claim 1, column 7, change "indicator light" to --indicator lights-- in line 55

In claim 8, column 8, change "indicator light" to --indicator lights-- in line 51

In claim 9, column 9, line 3, add "engaging said mounting bar." following "restrainably" in line 2

Signed and Sealed this

Sixteenth Day of January, 1990

*Attest:*

JEFFREY M. SAMUELS

*Attesting Officer*

*Acting Commissioner of Patents and Trademarks*